US009828782B2

(12) United States Patent
Wang et al.

(10) Patent No.: US 9,828,782 B2
(45) Date of Patent: Nov. 28, 2017

(54) HOLE REPAIR DEVICE, KIT AND METHOD

(71) Applicant: 3M INNOVATIVE PROPERTIES COMPANY, St. Paul, MN (US)

(72) Inventors: DanLi Wang, Shoreview, MN (US); Michael E. Kuhl, Cottage Grove, MN (US); Dwight B. Schoenherr, Stillwater, MN (US); Judd D. Olson, Deephaven, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/030,399

(22) PCT Filed: Jun. 10, 2015

(86) PCT No.: PCT/US2015/035053

§ 371 (c)(1),
(2) Date: Apr. 19, 2016

(87) PCT Pub. No.: WO2015/195429

PCT Pub. Date: Dec. 23, 2015

(65) Prior Publication Data

US 2017/0107729 A1 Apr. 20, 2017

Related U.S. Application Data

(60) Provisional application No. 62/015,061, filed on Jun. 20, 2014, provisional application No. 62/111,865, filed on Feb. 4, 2015.

(51) Int. Cl.
*E04G 23/02* (2006.01)

(52) U.S. Cl.
CPC ..... *E04G 23/0207* (2013.01); *E04G 23/0214* (2013.01)

(58) Field of Classification Search
CPC ..... E04G 23/0207; E04G 23/0214; E04G 23/0203
(Continued)

(56) References Cited

U.S. PATENT DOCUMENTS 3,373,467 A * 3/1968 Loughrey ..... F27D 1/16 114/227
3,583,122 A * 6/1971 Biegajski ..... E04G 23/0203 428/63
(Continued)

FOREIGN PATENT DOCUMENTS

JP H10-152899 6/1998
WO WO 2009/119690 A1 10/2009

OTHER PUBLICATIONS

PCT International Search Report from PCT/US2015/035053 dated Aug. 26, 2015, 2 pages.
(Continued)

*Primary Examiner* — Brian Mattei
*Assistant Examiner* — Paola Agudelo
(74) *Attorney, Agent, or Firm* — Kevin Weber

(57) ABSTRACT

A backing device useful in repairing a hole. In some embodiments, the hole is in a wall, for example a relatively large hole in a wall (e.g., vertical wall, ceiling, etc.) of, for example, a home or building structure. The backing device includes a collapsible backing member and adhesive strips. The backing member defines a front face opposite a rear face, and includes first and second panels connected at a hinge segment. The adhesive strips are disposed on the front face. The backing member is foldable from a flat state to a collapsed state for insertion through the wall hole. Once deployed "behind" the wall, the backing member is transitioned to the flat state, and the adhesive strips utilized to secure the backing device to a back surface of the wall. In some embodiments, the backing device, while in the flat
(Continued)

state, is relatively rigid in one direction and collapsible in the opposite direction.

19 Claims, 16 Drawing Sheets

(58) Field of Classification Search
USPC ..... 52/514
See application file for complete search history.

(56) References Cited

U.S. PATENT DOCUMENTS

| | | | | |
|---|---|---|---|---|
| 3,690,084 | A * | 9/1972 | Leblanc | E04G 23/0203 428/63 |
| 3,717,970 | A | 2/1973 | Rosenblum | |
| 3,874,505 | A * | 4/1975 | Mirarchi | E04G 23/0203 206/231 |
| 3,936,988 | A | 2/1976 | Miceli | |
| 4,013,475 | A | 3/1977 | Liebowitz et al. | |
| 4,075,809 | A * | 2/1978 | Sirkin | E04G 23/0203 52/514 |
| 4,152,165 | A | 5/1979 | Langager et al. | |
| 4,335,554 | A * | 6/1982 | Nicholson | E04G 23/0203 52/514 |
| 4,338,377 | A | 7/1982 | Beck et al. | |
| 4,354,332 | A | 10/1982 | Lentz | |
| 4,370,842 | A | 2/1983 | Martin et al. | |
| 4,578,854 | A | 4/1986 | Demeglio | |
| 4,809,478 | A | 3/1989 | Bernard | |
| 4,830,773 | A | 5/1989 | Olson | |
| 5,018,331 | A * | 5/1991 | Forzano | E04G 23/0203 52/514 |
| 5,033,949 | A * | 7/1991 | Jewett | E04G 23/0203 264/30 |
| 5,058,519 | A | 10/1991 | Collins | |
| 5,353,568 | A | 10/1994 | Silva | |
| 5,705,583 | A | 1/1998 | Bowers et al. | |
| 5,778,624 | A * | 7/1998 | Russell | E04G 23/0203 52/514 |
| 5,936,703 | A | 8/1999 | Miyazaki et al. | |
| 6,071,833 | A | 6/2000 | D'Alisa et al. | |
| 6,156,108 | A | 12/2000 | Wachowiak, Jr. | |
| 6,225,431 | B1 | 5/2001 | Bowers et al. | |
| 6,314,703 | B1 | 11/2001 | Ikuta et al. | |
| 6,347,496 | B1 | 2/2002 | Pinkins | |
| 6,508,040 | B2 | 1/2003 | Nelson | |
| 6,531,528 | B1 | 3/2003 | Kurp | |
| 6,916,773 | B2 | 7/2005 | Griese et al. | |
| 6,972,277 | B2 | 12/2005 | Dietz | |
| 6,994,890 | B2 | 2/2006 | Ohlhausen et al. | |
| 7,330,691 | B2 | 2/2008 | Yoo | |
| 7,790,796 | B2 | 9/2010 | Foster et al. | |
| 7,971,405 | B2 | 7/2011 | Hansen | |
| 8,021,505 | B2 * | 9/2011 | Lewis | E04G 23/0203 156/71 |
| 8,088,724 | B2 | 1/2012 | Iverson et al. | |
| 8,328,970 | B2 | 12/2012 | Lewis | |
| 8,354,368 | B2 | 1/2013 | Schunicht et al. | |
| 8,381,474 | B2 | 2/2013 | Lewis | |
| 8,772,215 | B2 | 7/2014 | Ryther et al. | |
| 8,978,341 | B2 * | 3/2015 | Maanum | F16K 3/03 52/2.11 |
| 2006/0101765 | A1 | 5/2006 | Bailey | |
| 2006/0123728 | A1 * | 6/2006 | Clark | E04G 23/0203 52/514 |
| 2007/0116968 | A1 | 5/2007 | Dierdorf et al. | |
| 2007/0125035 | A1 | 6/2007 | Herbold | |
| 2009/0084062 | A1 | 4/2009 | Riggs | |
| 2009/0202816 | A1 | 8/2009 | Schlenoff | |
| 2010/0129672 | A1 | 5/2010 | Hao et al. | |
| 2010/0317559 | A1 | 12/2010 | Ryther et al. | |
| 2011/0107705 | A1 * | 5/2011 | Georgievski | E04G 23/0203 52/514 |
| 2012/0273000 | A1 | 11/2012 | Jing et al. | |
| 2012/0295829 | A1 | 11/2012 | Peitersen et al. | |
| 2013/0023458 | A1 | 1/2013 | Hodge et al. | |
| 2013/0164730 | A1 | 6/2013 | Gustafson et al. | |
| 2013/0190430 | A1 | 7/2013 | Gozum et al. | |
| 2013/0256583 | A1 | 10/2013 | Schlenoff et al. | |
| 2014/0060583 | A1 | 3/2014 | Riddle et al. | |
| 2015/0105506 | A1 | 4/2015 | Benighaus et al. | |
| 2015/0197950 | A1 | 7/2015 | Lewis | |

OTHER PUBLICATIONS

Cumpson, "The Thickogram: a method for easy film thickness measurement in XPS," *Surface and Interface Analysis*, 2000; 29(6):403-406.

Kirk-Othmer, *Encyclopedia of Chemical Technology, 3rd Edition*, 1979; vol. 8; pp. 900-912.

Litt et al., "Siloxane zwitterions: Synthesis and surface properties of crosslinked polymers," *Journal of Applied Polymer Science*, 1975; 19(5):1221-1225.

McNaught et al., "zwitterionic compounds/zwitterions," IUPAC. Compendium of Chemical Terminology, 2nd ed. (the "Gold Book"). Blackwell Scientific Publications, Oxford, 1997, Last update: Feb. 24, 2014. Retrieved from the Internet: <URL:http://goldbook.iupac.org/Z06752.html>; 1 page.

Pujari et al., "Covalent Surface Modification of Oxide Surfaces," *Angewandte Chemie International Edition*, 2014; 53(25):6322-6356.

Qiu et al., "Development and evaluation of new zwitterionic Hydrophilic interaction liquid chromatography stationary phases based on 3-P,P-diphenylphosphonium-propylsulfonate," *Journal of Chromatography A*, 2011; 1218(44):8075-8082.

U.S. Appl. No. 61/287,555, filed Dec. 17, 2009, entitled "Sulfonate-Functional Coatings and Methods." 3M No. 65881US002.

U.S. Appl. No. 61/416,938, filed Nov. 24, 2010, entitled "Articles with Rewritable Surfaces and Methods for Making and Using Same." 3M No. 67141US002.

* cited by examiner

HOLE REPAIR DEVICE, KIT AND METHOD

BACKGROUND

The present disclosure relates generally to devices, kits and methods for repairing a hole in, for example wood, drywall, plaster, etc. More particularly, it relates to devices for providing a scaffolding-type structure behind a hole (e.g., in some embodiments, a hole in a wall) for supporting a repair compound, and related kits and methods.

Interior walls of homes and buildings are often constructed using gypsum wallboard panels (sometimes referred to as drywall). When cavities, recesses, holes, etc., are present (due to imperfections or damage), it is common to use a wall repair compound, and in particular a spackling compound, to fill such cavities. Conventional spackling compounds often include one or more inorganic fillers, one or more polymeric resin binders, and various thickeners and other additives. Lightweight spackling compounds have been developed that often contain, among other inorganic fillers, relatively low density fillers such as glass bubbles, hollow silica, or expanded perlite. After the spackling compound is applied to a wall, the water evaporates over a period of time resulting in the formation of a dried, hardened material that can be sanded, painted, etc.

Spackling compounds are known in the art. U.S. Pat. No. 6,531,528 (Kurp), for example, discloses a ready-to-use patch repair product that includes a color change indicator. After the product has dried, the color changes to signal that, if desired, the user can perform other operations such as painting, sanding, etc., on the surface. U.S. Pat. No. 7,790,796 (Foster et al.) discloses a spackling compound that it easy to apply smoothly, can be applied in thicker layers than known spackling compounds without cracking upon drying, and can be modified after drying without pitting, flaking, or crumbling, particularly at the edges of the applied spackling patch. U.S. Publication No. 2013/019043 (Gozum et al.) discloses a self-priming spackling compound.

These and other spackling compounds are well accepted by end users across a wide range of skillsets, from seasoned professionals to persons with much less experience such as a do-it-yourself (DIY) homeowner. In practice, small holes, cracks, etc., are easily repaired with spackle. Larger wall holes are typically much more difficult to repair. Large holes (e.g., major dimension of at least 2 inches, through an entire thickness of the wall) can be caused in many different ways (e.g., impact of door knob), and typically cannot be repaired by simply applying a spackling compound into the hole. Due to the size of the hole, there is insufficient wall surface area for the spackling compound to stick to; instead, if an attempt is made to fill in the hole, a majority of the spackling compound will simply fall through the hole (dropping along the "hidden" rear surface of the wall being repaired).

One technique employed by professionals for addressing a large wall hole is to cut a section of the wall surrounding the hole to a conventional size (e.g., corresponding with stud spacing behind the wall). The cut wall section is removed and replaced with a piece of similar wall material cut to the same size. In many instances (e.g., drywall), this approach further requires that the joints between the new wall section and the existing wall be taped, mudded and sanded. These techniques require professional skills and are simply not practical for DIYers.

Alternatively, a scaffolding of some type is formed over or within the hole, and the spackling compound is then applied on to the scaffolding. While in theory this approach is straightforward, in actual practice it is difficult to accomplish. The primary challenge is assembly of the scaffolding to the wall. Optimally, the scaffolding would be attached to the hidden "rear" surface of the wall so that a thickness of the scaffolding does not project beyond the visible front surface. However, this can only be accomplished by manipulating the scaffolding through the existing hole from the outside/front; this can be exceedingly difficult, especially when also attempting to anchor the scaffolding to the wall. Given these obstacles, a conventional approach is to tape a section of wire mesh or a galvanized steel panel to the front surface of the wall, over the hole. Spackle is applied on to the wire mesh. Because the wire mesh is "in front" of the wall surface, the spackle must later be carefully sanded (or feathered) to present a relatively smooth continuum with the existing wall surface. While accepted, this technique is time-consuming and can be quite frustrating for inexperienced persons, such as most DIYers.

Various methods and devices have been suggested to facilitate assembly of a scaffold to the back surface of the wall via the existing hole. Unfortunately, known devices are costly, difficult to manipulate, and have met with limited, if any, commercial success.

SUMMARY

The inventors of the present disclosure recognized a need exists for a large hole repair device that is easily manipulated through an existing hole and easily attached to a back surface surrounding the hole. In some embodiments, the hole is in a vertical wall.

Some aspects of the present disclosure are directed toward a backing device useful in repairing a hole. In some embodiments, the hole is in a wall for example a relatively large hole in a wall (e.g., vertical wall, ceiling, wall or panel of a hollow door, etc.) of, for example, a home or building structure. The backing device includes a collapsible backing member and adhesive strips. The backing member defines a front face opposite a rear face, and includes first and second panels connected at a hinge segment. The adhesive strips are disposed on the front face. The backing member is foldable from a flat state to a collapsed state for insertion through the wall hole. Once deployed "behind" the wall, the backing member is transitioned to the flat state, and the adhesive strips utilized to secure the backing device to a back surface of the wall. Upon final assembly to the wall, the backing device covers or encompasses at least a portion of the hole, and serves as, or as part of, a scaffolding structure for receiving a wall repair compound. In some embodiments, the backing device, while in the flat state, is relatively rigid in one direction and collapsible in the opposite direction.

Other aspects of the present disclosure are directed toward a kit for repairing a large hole in a wall. The kit includes at least one of the backing devices described above, along with a wall repair compound. The kit optionally includes other components such as one or more cover articles, tools, instructions for use, etc.

DETAILED DESCRIPTION

Wall repair backing devices, kits and methods of the present disclosure are suitable for facilitating the repair of relatively large holes in walls (e.g., holes having a major dimension of at least 2 inches and formed through an entire thickness of the wall) of various constructions, such as gypsum wallboards, drywall, wood, concrete, stucco, brick, etc. The devices, kits and methods of the present disclosure can be used to repair any wall orientation (e.g., vertical wall, ceiling, wall or panel of a hollow door, etc.).

Figure 1A:
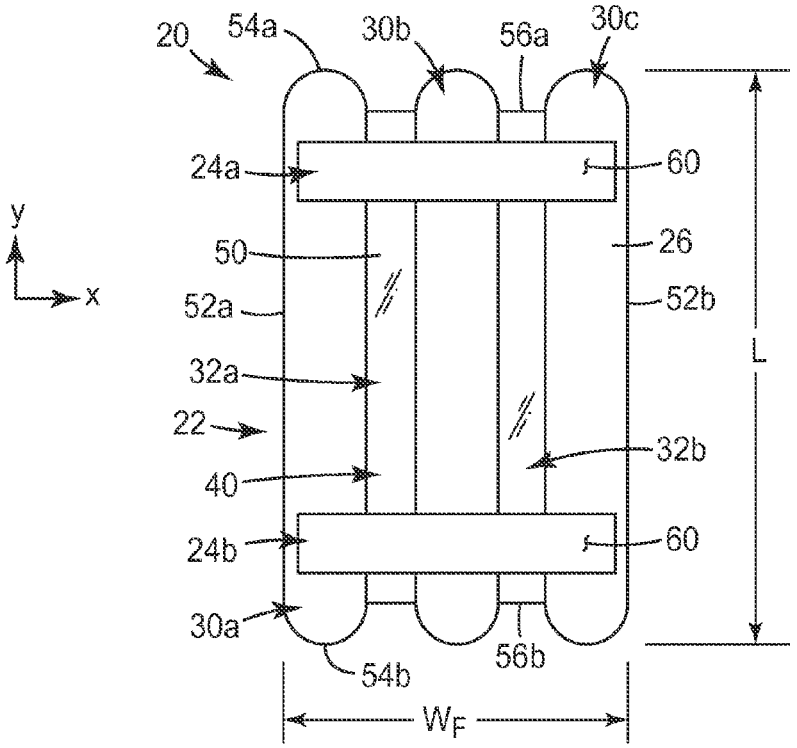
FIG. 1A is a front plan view of a wall repair backing device in accordance with principles of the present disclosure and in a flat state.
Figure 1B:
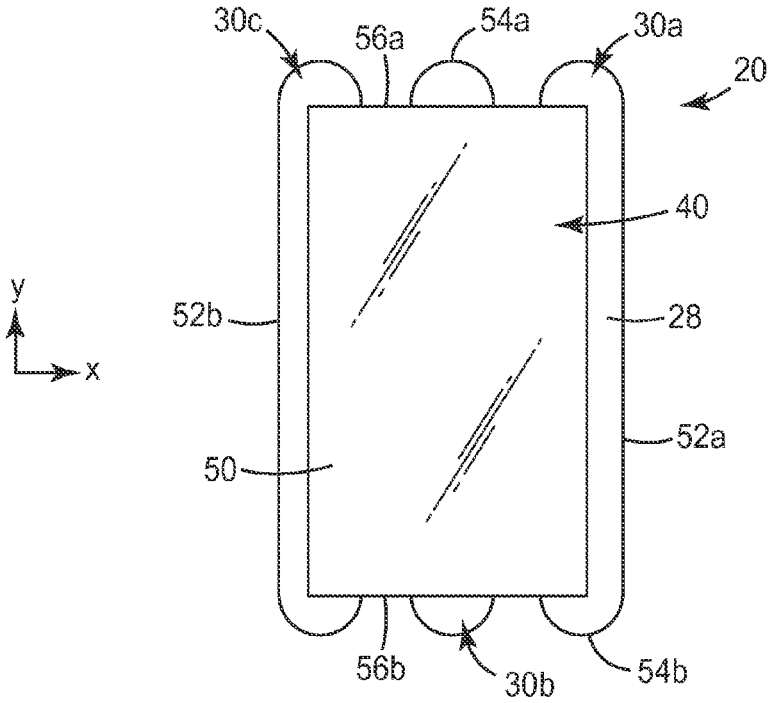
FIG. 1B is a rear plan view of the backing device of FIG. 1A.

One embodiment of a wall repair backing device 20 in accordance with principles of the present disclosure is shown in FIGS. 1A and 1B. The backing device 20 includes a foldable backing member 22 and at least two adhesive strips 24*a*, 24*b*. Details on the various components are provided below. In general terms, however, the backing member 22 is foldable or collapsible from the flat state of FIGS. 1A and 1B (having a size or footprint that is larger, in at least one dimension, than the hole to be repaired) to a collapsed or folded state that more readily fits through the hole to be repaired. Once manipulated through the hole, the backing member 22 is permitted or caused to revert to the flat state (including the backing member 22 optionally self-reverting back toward the flat state). Then, with the backing member 22 in the flat state, the backing device 20 is attached to a back surface of the wall via the adhesive strips 24*a*, 24*b*. In some embodiments, the backing member 22 is readily collapsible from the flat state in one direction and is relatively rigid (in the flat state) in the opposite direction.

The backing member 22 generally defines a front face 26 (FIG. 1A) opposite a rear face 28 (FIG. 1B). The backing member 22 can assume a wide variety of forms capable of being folded from the flat state to a collapsed state, and exhibiting sufficient rigidity in at least one direction (while in the flat state). In more general terms, the backing member 22, in the flat state of FIGS. 1A and 1B, has a two-dimensional shape or footprint in an x, y plane, with the shape having a maximum length L in the y direction, and a maximum flattened width $W_F$ in the x direction. As a point of reference, the collapsible nature of the backing member 22 as described below is relative to the width (and depth) directions, such that the maximum length L of the backing member 22 does not change between the flat and collapsed states in some embodiments. The maximum length L is greater than the maximum flattened width $W_F$, and is selected to be greater than an expected size of the wall hole to be repaired for reasons made clear below. Thus, in some embodiments, the maximum length L is on the order of at least 3 inches, alternatively at least 4 inches, alternatively at least 5 inches, alternatively at least 6 inches. In related embodiments, as provided to an end user, the backing member 22 can have a maximum length L that is on the order of 5 inches or more, and the end user is able to manually trim the backing member 22 to a shorter maximum length L in accordance a size of the hole to be repaired (e.g., the maximum length L of the backing member 22 as installed should be sufficiently sized to extend across the maximum dimension of the hole to be repaired and locate the opposing adhesive strips 24*a*, 24*b* in contact with a surface of the wall at opposite sides of the hole).

Figure 2:
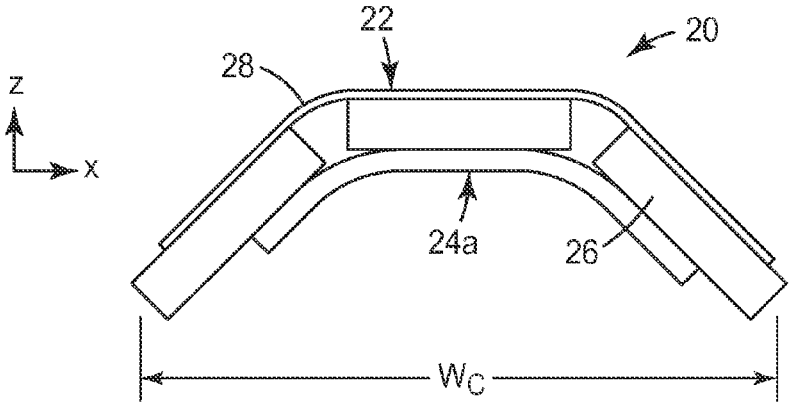
FIG. 2 is a side view of the backing device of FIG. 1A in a collapsed state.

The maximum flattened width $W_F$ in the flat state can also have a variety of dimensions generally corresponding with an expected size of the hole to be repaired. In some embodiments, the maximum flattened width $W_F$ can be on the order of 1-5 inches. Regardless, the maximum flattened width $W_F$ in the flat state can approximate, or be slightly larger than, the maximum dimension of the hole to be repaired. Under these circumstances, the backing member 22 (in the flat state) will not easily "fit" through the hole (as the maximum length L and the maximum flattened width $W_F$ establish a footprint greater than a size of the hole to be repaired). Due to the collapsible or foldable construction, however, the backing member 22 can be manually articulated to a collapsed state, one example of which is reflected in the side view of FIG. 2. As shown, collapsing of the backing member 22 (for example, in a direction of the front face 26) entails a decrease in width (or X direction) and an increase in depth (Z direction). A maximum collapsed width $W_C$ of the backing member 22 in the collapsed state is less than the maximum flattened width $W_F$ (FIGS. 1A and 1B), and allows the backing member 22 (in the collapsed state) to more easily pass through the hole to be repaired.

Returning to FIGS. 1A and 1B, in some embodiments the backing member 22 includes a plurality of panels 30, immediately adjacent ones of which are connected by a corresponding hinge segment 32. For example, the exemplary backing member 22 of FIGS. 1A and 1B includes three of the panels 30*a*, 30*b*, 30*c* and two of the hinge segments 32*a*, 32*b* (with the first and second panels 30*a*, 30*b* connected to one another at the first hinge segment 32*a*, and the second and third panels 30*b*, 30*c* connected to one another at the second hinge segment 32*b*). Alternatively, the backing member 22 can include as few as two of the panels 30 (and a single one of the hinge segments 32), or three or more of the panels 30 (and a corresponding number of the hinge segments 32).

The panels 30 can be identical, and are formed of a relatively thin, structurally robust material such as wood, plastic, cardboard, etc. In an exemplary embodiment, the panels 30 are each akin to a conventional wooden or plastic pop-stick, popsicle stick or tongue depressor. The panels 30 can have a variety of dimensions. It will be understood that the widths of each of the panels 30 (along with a spacing between the panels 30 in the width direction x) combine to define the maximum flattened width $W_F$ of the backing member 22. Thus, in order to provide sufficient surface area for "covering" expected holes, the number of panels 30 provided with the backing member 22 will increase with smaller width panels 30. In some embodiments, each of the panels 30 has a width on the order of 0.1-1.5 inches, alternatively on the order of 0.25-1.0 inch, alternatively on the order of 0.4-0.8 inch. In yet other embodiments, the panels 30 are each pop-sticks having a nominal width of 0.625 inch. The panels 30 can be discretely formed and subsequently connected as shown; in other embodiments, the backing member 22 can be provided as an integral, homogenous body as described below.

The hinge segments 32, and thus hinged or pivotable connection between adjacent ones of the panels 30, can be established in a wide variety of fashions. In some embodiments, the hinge segments 32 are generated by at least one flexible material layer or film 40 secured to (and across) the collective panels 30. With this construction, the material layer or film 40 establishes or forms each of the hinge segments 32. The material layer or film 40 can be applied at the rear face 28 of the backing member 22 as shown, or can be at the front face 26. Regardless, the material layer or film 40 is configured to readily flex or articulate at each of the hinge segments 32 (e.g., due to thin nature of the material layer or film 40). In some embodiments, the material layer or film 40 is an adhesive tape, such as any of the masking tape products available from 3M Company. The adhesive provided with the tape is selected to be compatible with (i.e., establishes a strong bond to) the material of the panels 30. Other material layers capable of securing the panels 30 relative to one another and also providing the flexible hinge segments 32 are also envisioned.

While FIGS. 1A and 1B illustrate the material layer or film 40 as a single, homogenous body, in other embodiments, two or more strips of material or film can be utilized to collectively connect the panels 30 and generate the hinge segments 32. Regardless, the material layer or film 40 is sized and arranged relative to the panels 30 so as to establish a central region 50 of the backing member 22 in which the backing member 22 is optionally continuous or contiguous across the panels 30 and hinge segments 32 in the x and y directions. Stated otherwise, the panels 30 can be viewed as collectively defining a perimeter of the backing member 22, including opposing side edges 52*a*, 52*b*, and opposing end edges 54*a*, 54*b*. The material layer or film 40 is attached to and extends between the outer-most panels 30*a*, 30*c*. In some embodiments, the material layer or film 40 need not necessarily extend to the opposing end edges 54*a*, 54*b* (e.g., the material layer or film 40 terminates at opposing margins 56*a*, 56*b* that are spaced from the corresponding end edges 54*a*, 54*b* of the panels 30). Thus, a spacing between adjacent ones of the panels 30*a*-30*c* outside of the central region 50 remains open. However, in the central region 50, the backing member 22 is continuous or contiguous in the x, y directions (i.e., the spacing between adjacent ones of the panels 30*a*-30*c* is encompassed by the material layer or film 40). Thus, in the x (or width) direction, the backing member 22 is continuous or contiguous between the opposing side edges 52*a*, 52*b* in the central region 50. The backing member 22 is also continuous or contiguous in the y (or height) direction in the central region 50 (i.e., the material layer or film 40, and thus the hinge segments 32, is continuous or contiguous between the opposing margins 56*a*, 56*b*, as are the panels 30 (that are otherwise each continuous or contiguous between the opposing end edges 54*a*, 54*b*)). With this continuous or contiguous construction, the central region 50 establishes a complete or continuous surface through which a wall repair compound will not leak or protrude.

The adhesive strips 24*a*, 24*b* are applied to the front face 26 of the backing member 22 and can be identical in some embodiments. The adhesive strips 24*a*, 24*b* are generally constructed to provide an adhesive surface 60 appropriate for bonding to a material of the wall to be repaired. For example, the adhesive strips 24*a*, 24*b* can be provided as double-sided adhesive tape strips available from 3M Company (e.g., any of the double sided foam tapes available from 3M Company under the trade designations Double Coated Urethane Foam Tape or Double Coated Polyethylene Foam Tape). While the adhesive strips 24*a*, 24*b* are each illustrated as extending across the spacing between adjacent ones of the panels 30, in other embodiments one or both of the adhesive strips 24*a*, 24*b* can be formed as discrete sections applied to individual ones of the panels 30. A plethora of other constructions (e.g., a spray-on type adhesive) are equally acceptable.

The adhesive surface 60 can be generated by a wide range of appropriate adhesives, such as a pressure sensitive adhesive, a permanent adhesive, etc., as are known in the art. In related embodiments, as initially provided to an end user, the backing device 20 can include release liners (not shown) releasably disposed over the respective adhesive surfaces 60. In other embodiments, a release liner (or similar structure) is not necessary/can be omitted. For example, the adhesive utilized with the adhesive strips 24*a*, 24*b* can be configured to be "activated" in response to an applied force (e.g., such as the force encountered when the adhesive surface 60 is pressed against a wall surface as described below). In some embodiments, then, the adhesive of the adhesive strips 24*a*, 24*b* can be a microencapsulated adhesive in which the adhesive component is contained or encapsulated in a glass microbubble as known in the art (e.g., a low strength glass microbubble encapsulating a polyurethane adhesive) adapted to break open in response to a shearing or compressing force; once broken, the adhesive component is exposed and available for bonding to a surface placed into contact with the adhesive surface 60.

In some embodiments, the backing device 20, as provided to an end user, includes the adhesive strips 24*a*, 24*b* pre-applied to the backing member 22. In other embodiments, for example with some kits of the present disclosure, one or both of the adhesive strips 24*a*, 24*b* can be provide to the end user separate from the backing member 22; with these optional embodiments, then, the end user secures one or both of the adhesive strips 24*a*, 24*b* to complete the backing device 20. With this optional format, the end user can trim the backing member 22 to a desired size before both of the adhesive strips 24*a*, 24*b* are secured thereto.

The backing device 20 can assume other forms differing from those described above, and optionally can include one or more additional components. For example, the backing device 20 may further include a tether (not shown) as described below in connection with other embodiments of the present disclosure.

Figure 3:
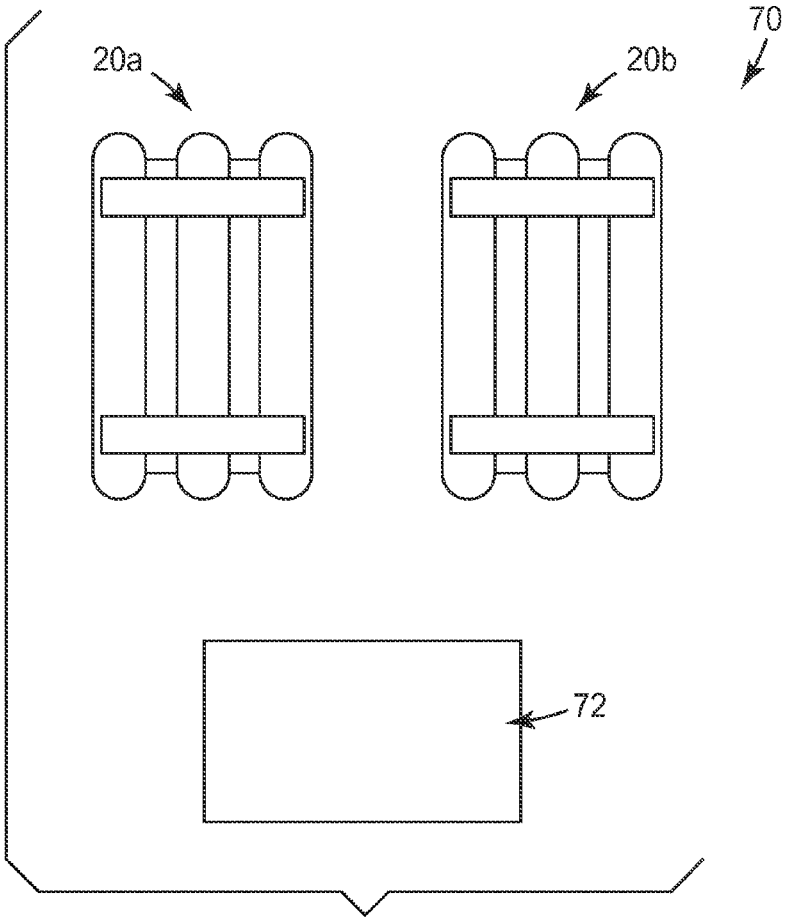
FIG. 3 is a simplified view of a wall repair kit in accordance with principles of the present disclosure.

The backing device 20 can be used to facilitate repair of a hole in a wall, and can be provided as part of a kit 70 shown in FIG. 3. The kit 70 optionally includes two (or more) of the backing devices 20 (e.g., the backing devices 20A and 20B) as well as a wall repair compound 72 (e.g., spackling compound). The wall repair compound 72 is typically packaged in a closed container, and can have any formulation appropriate for the particular type of wall material being worked upon (e.g., where the wall to be repaired is drywall, the wall repair compound 72 can be any known or available spackling compound). In some embodiments, a formulation of the wall repair compound 72 is optionally well-suited for filling and repairing large holes in drywall, such as the formulations described in U.S. Patent Application Nos. 62/015,076, 62/110,038, and 62/110,762 entitled "Large Hole Wall Repair Compound and Methods of Use", the entire teachings of which are incorporated herein by reference. In related embodiments, the kit 70 includes packaging commonly containing the backing devices 20 and the wall repair compound 72, as well as optional additional items such as written instructions for use, one or more tools (e.g., spackling tool, putty knife, etc.).

Figure 4A:
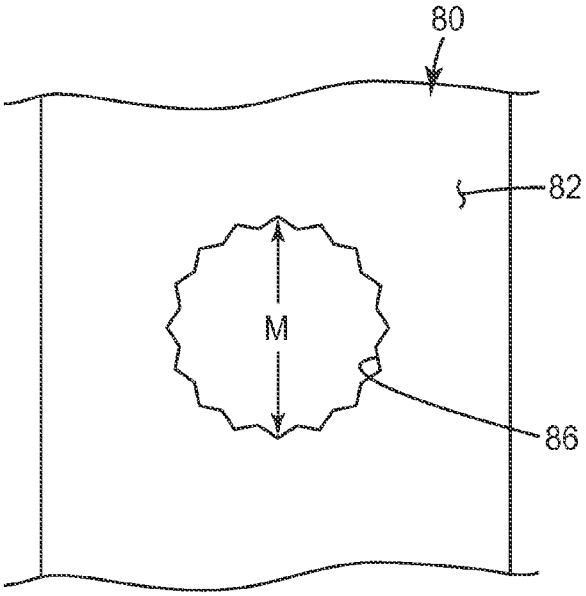
FIGS. 4A-10 illustrate use of the backing device of FIG. 1A in repairing a hole in a wall.
Figure 4B:
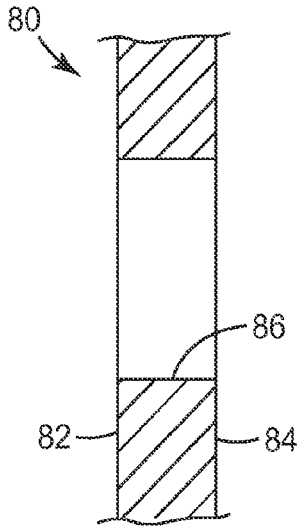

Regardless of whether the backing device 20 is provided to the end user as part of kit, use of the backing device 20 in facilitating repair of a wall hole can be initially described with reference to FIGS. 4A and 4B that depict a wall 80. The wall 80 forms or defines a front surface 82 opposite a back surface 84. As a point of reference, the wall 80 can be a vertical wall provided as part of a building or home frame construction in which the wall 80 is attached to framework (e.g., studs) at the back surface 84. Under these circumstances, the front surface 82 will face the user and is visible, whereas the back surface 84 is covered or hidden. The user does not have direct or easy access to the back surface 84. Regardless, a hole 86 is formed through the wall 80 (i.e., extends between, and is open to, the front and back surfaces 82, 84). The user desires to repair the hole 86. The backing devices 20 (FIGS. 1A and 1B) of the present disclosure are well suited for repairing a plethora of differently sized and shapes holes 86; in some embodiments, the hole 86 is relatively large (e.g., a major dimension of at least 2 inches).

In some optional embodiments, and with additional reference to FIG. 1A, prior to deploying the backing device 20, the user can first visually compare a size of the hole 86 with a size of the backing device 20 (in the flat state). In general terms, a relationship of a size of the backing device 20 with a size of the hole 86 is desirably such that a distance between the opposing adhesive strips 24*a*, 24*b* is slightly greater than a maximum dimension of the hole 86 (such that the adhesive strips 24*a*, 24*b* can be arranged against the wall 80 in spaced relation to opposite sides of the hole 86). Under circumstances where the backing device 20 is determined to be much larger than the hole 86 (e.g., the length L of the backing device 20 is substantially greater than a maximum dimension (identified at M in FIG. 4A) of the hole 86), the user can trim the backing device 20 to a smaller size (e.g., a decreased length L). At least a portion of each of the adhesive strips 24*a*, 24*b* should remain following the trimming operation. In related alternative embodiments, the backing member 22 is initially provided to the user apart from one or both of the adhesive strips 24*a*, 24*b*; under these circumstances, the user applies one or both of the adhesive strips 24*a*, 24*b* after trimming the backing member 22 to a desired size. In other embodiments, a size of the backing device 20 is not adjusted by the user prior to deployment.

Figure 5A:
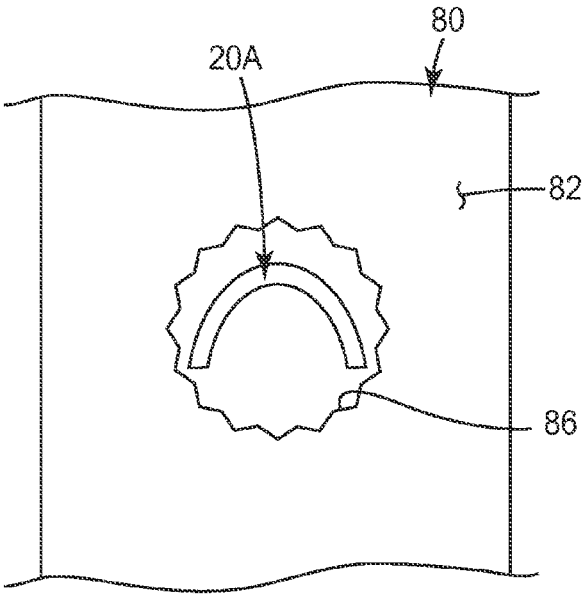
Figure 5B:
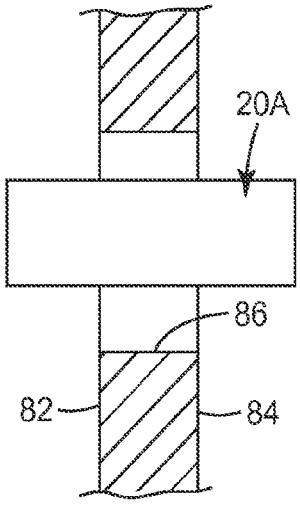

As shown in FIGS. 5A and 5B, a first backing device 20A (schematically illustrated) is provided, and the corresponding backing member 22 is manually folded by the user to a collapsed state. In the collapsed state, the backing device 20A readily "fits" through the hole 86 (as compared to an attempt to insert the backing device 20A through the hole 86 with the backing member 22 in the flat state).

Figure 6A:
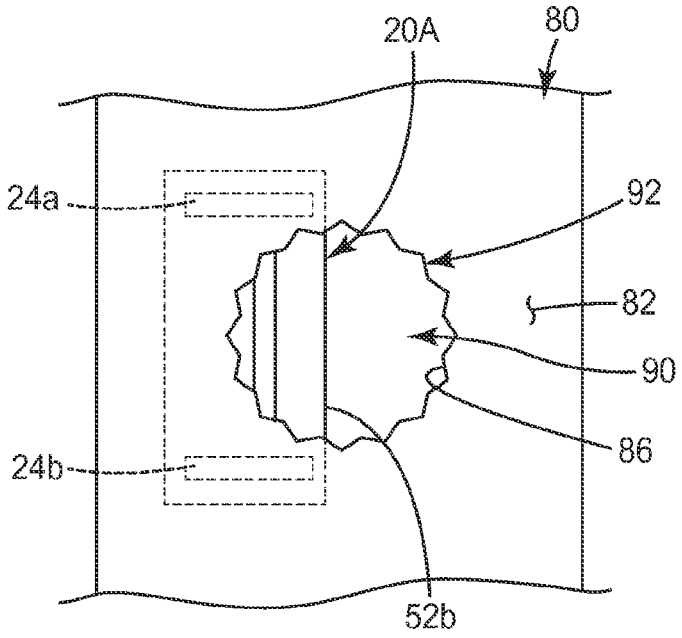
Figure 6B:
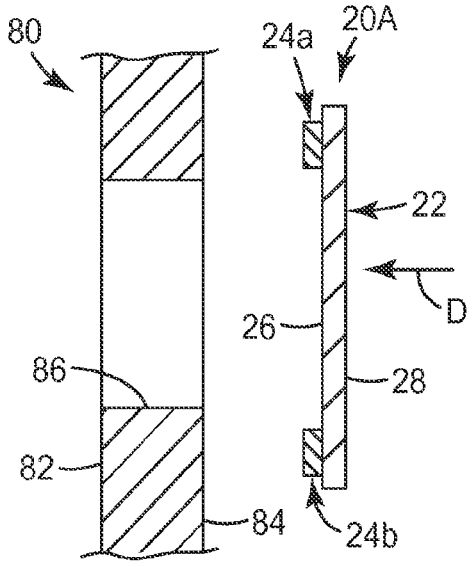
Figure 6C:
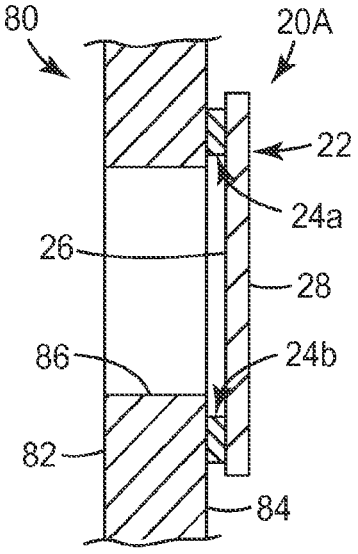

Once the backing device 20A is entirely through the hole 86 (and thus is adjacent the back surface 84), the backing member 22 is allowed or caused to transition from the collapsed state to or toward the flat state as shown in FIGS. 6A and 6B. In the arrangement of FIG. 6A, the backing device 20A is located relative to the hole 86 such that a spacing 90 exists between the second side edge 52*b* and corresponding perimeter edge(s) 92 (referenced generally) of the wall 80 otherwise defining the hole 86. Thus, a user is able to easily grasp and manipulate the backing device 20A "through" the hole 86 (i.e., via the spacing 90). Handling the backing device 20A in this manner, the user arranges the backing device 20A, with the backing member 22 in or close to the flat state, such that the adhesive surface 60 of the adhesive strips 24*a*, 24*b* faces the back surface 84. With embodiments in which a release liner (not shown) is provided with each of the adhesive strips 24*a*, 24*b*, the release liner is optionally removed from the corresponding adhesive strip 24*a*, 24*b* immediately prior to inserting the backing device 20A through the hole 86, or immediately afterwards. With the backing device 20A arranged as shown (e.g., the adhesive strips 24*a*, 24*b* and the first side edge 52*a* are "outside" of the hole 86), the user directs the backing device 20A toward the back surface 84 (represented by an arrow D in FIG. 6B). The adhesive surface 60 of the adhesive strips 24*a*, 24*b* is thus brought into contact with the back surface 84 of the wall 80, connecting or securing the backing device 20A to the wall 80 as reflected by FIG. 6C. As the backing device 20A is pressed into contact with the back surface 84, forces are applied to opposing faces 26, 28 of the backing member 22 (e.g., the user-applied force at the rear face 28 and a resistance force by the wall 80 at the front face 26), causing the backing member 22 to assume the flat state.

Figure 7:
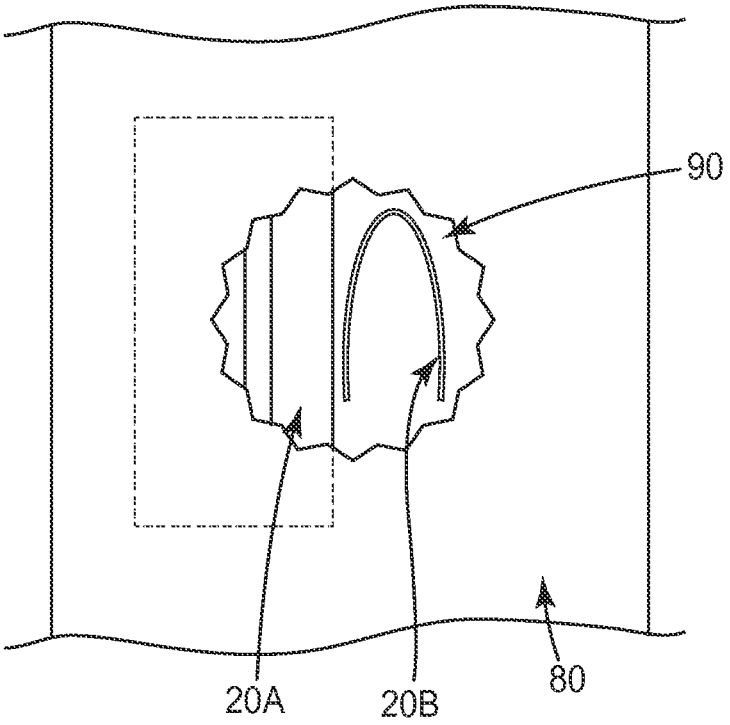

FIG. 7 reflects the first backing device 20A as secured to the wall 80. A second backing device 20B is then folded to a collapsed state sufficiently-sized for insertion through the hole 86 via the spacing 90. The second backing device 20B can optionally be trimmed to a desired size prior to deployment as described above. Regardless, the second backing device 20B is secured to the back surface 84 commensurate with the above descriptions, as reflected by FIGS. 8A (front view) and 8B (back view). As shown, in the final assembled arrangement, the first and second backing devices 20A, 20B encompass a majority of the hole 86, with the "exposed" portion of the central region 50 of the backing devices 20A, 20B each providing a continuous, uninterrupted surface. However, a gap 100 optionally remains between the backing devices 20A, 20B (as otherwise generated by the user's fingers when handling and pressing the second backing device 20B into contact with the back surface 84 of the wall 80). With some methods of the present disclosure, one or more additional components or articles are employed by the user to cover the gap 100.

Figure 8A:
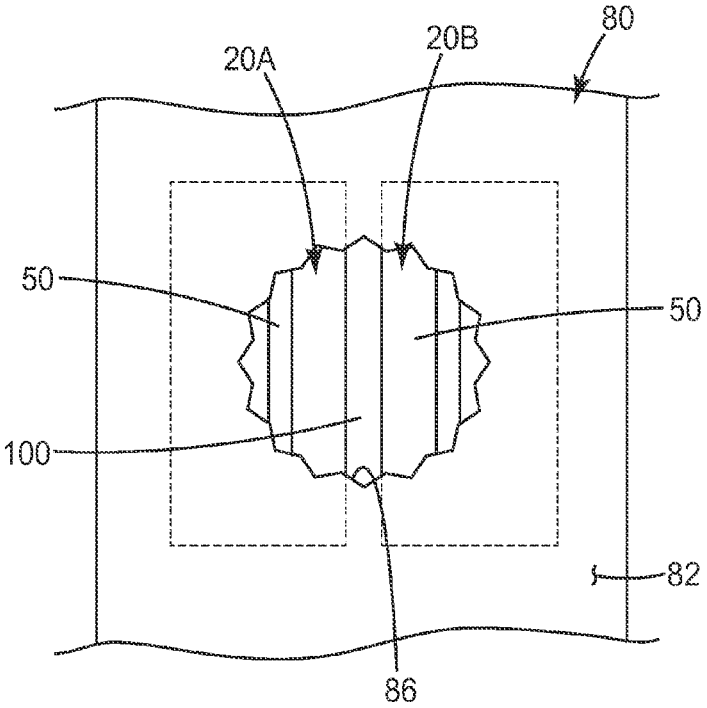
Figure 8B:
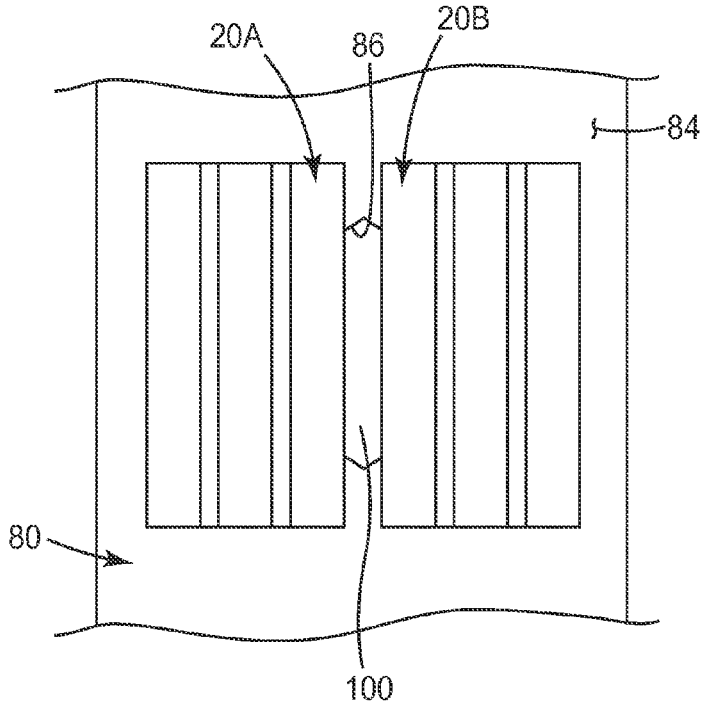
Figure 9A:
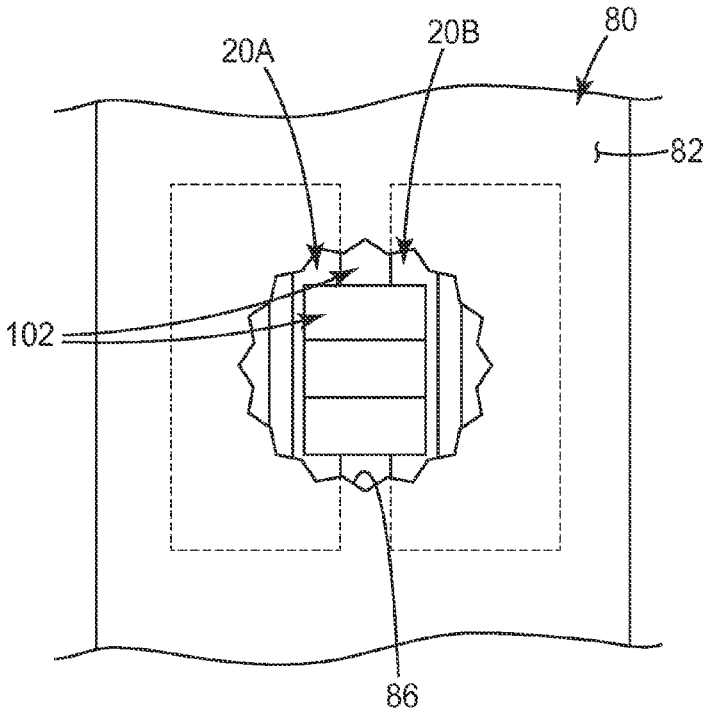
Figure 9B:
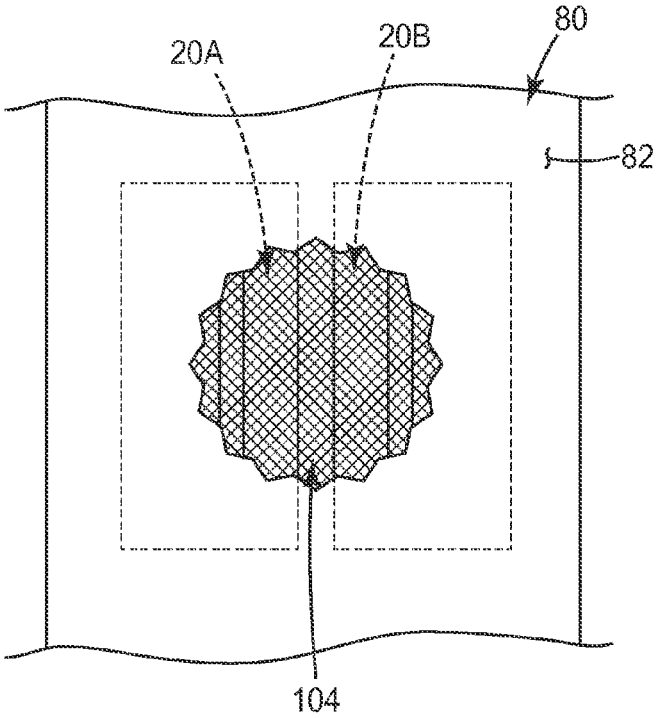
Figure 9C:
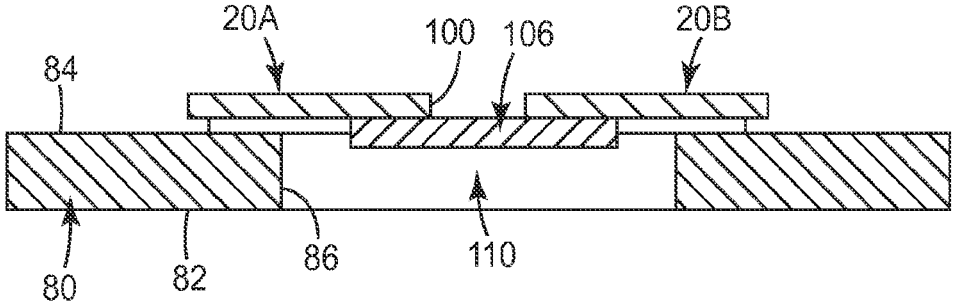

For example, FIG. 9A illustrates one optional embodiments in which tape strips 102 (or other, similar articles) are secured to the first and second backing devices 20A, 20B, extending across, and thus covering, the gap 100 (FIG. 8A). In related embodiments, the kits of the present disclosure can optionally include a roll of tape from which the tape strips 102 are generated or obtained. Alternatively, a metal mesh 104 can be cut to size and secured to the first and second backing devices 20A, 20B so as to encompass at least the gap 100 as shown in FIG. 9B. In related embodiments, the kits of the present disclosure can optionally include a sheet of metal mesh material (and optionally tape for securing a cut a segment of metal mesh material from the sheet). Other cover articles can alternatively be employed for covering the gap 100. Regardless of an exact construction, because the first and second backing devices 20A, 20B are secured to the back surface 84 of the wall (as opposed to being applied to the front surface 82), a thickness the tape strips 102, the mesh material 104, etc., as applied to the backing devices 20A, 20B in a region of the hole 86, will not project beyond the front surface 82. FIG. 9C generally illustrates this relationship, schematically depicting a cover article 106 assembled to the first and second backing devices 20A, 20B and extending across, and thus covering, the gap 100. The so-assembled cover article 106 does not generate a surface beyond a plane of the front surface 82 of the wall 80 that might otherwise create irregularities/non-planar transition to the front surface 82 by an applied wall repair compound as described below. As a point of reference, the assembled first backing device 20A, second backing device 20B, and cover article 106 collectively define a scaffold structure 110 that continuously encompasses the hole 86.

Figure 10:
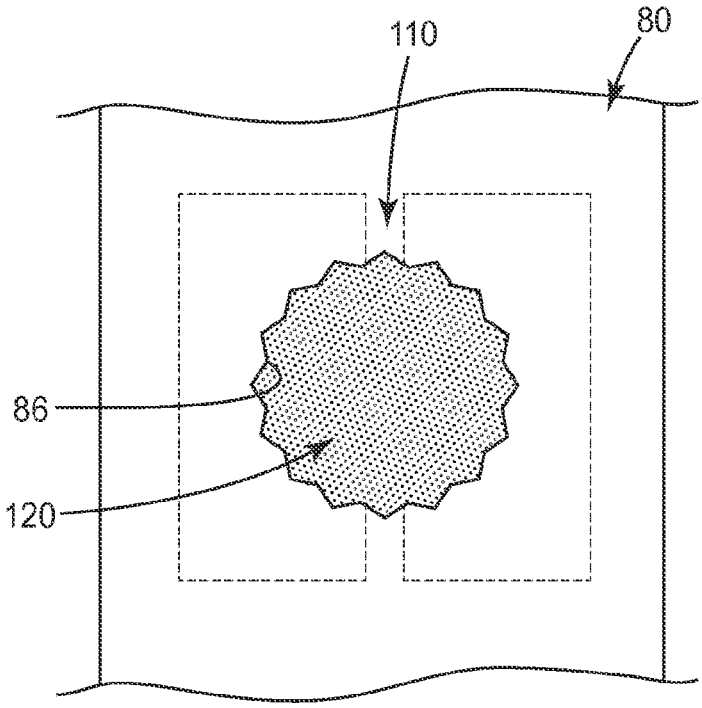

A wall repair compound 120 can then be applied into the hole 86 and onto the scaffold structure 110 as shown in FIG. 10. The wall repair compound 120 can be a spackling compound that is applied in a conventional manner (e.g., spread into the hole 86 and onto the spackling compound 120 with a spackle knife or similar tool). In other embodiments, the wall repair compound 120 can be formulated to have a more dough-like consistency (as described, for example, in U.S. Patent Application Nos. 62/015,076, 62/110,038, and 62/110,762 entitled "Large Hole Wall Repair Compound and Methods of Use", the entire teachings of which are incorporated herein by reference); with these and similar embodiments, methods of the present disclosure include the user rolling a volume of the dough-like wall repair compound to shape, and then inserting and pressing the shaped compound into the hole 86. Regardless, once dried, the applied wall repair compound 120 can be sanded or otherwise subjected to typical spackle finishing operations.

Figure 11:
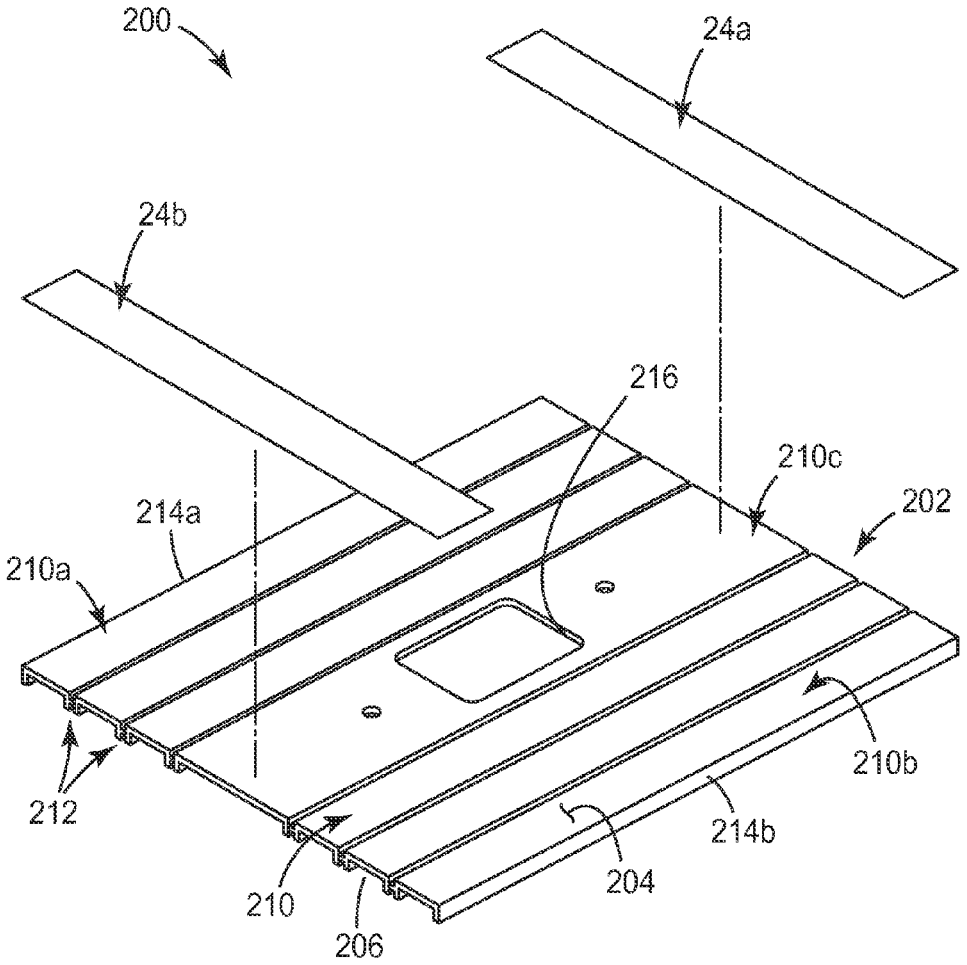
FIG. 11 is a perspective, exploded view of another wall repair backing device in accordance with principles of the present disclosure and useful with the kit of FIG. 3.

Another backing device 200 in accordance with principles of the present disclosure, and useful with optional kits and methods of the present disclosure, is shown in FIG. 11. The backing device 200 includes a backing member 202, as well as the first and second adhesive strips 24*a*, 24*b* (drawn generally) as described above. The backing member 202 generally defines a front face 204 opposite a rear face 206 (referenced generally), with the adhesive strips 24*a*, 24*b* being applied to the front face 204. Further, the backing member 202 is configured to be readily foldable from the flat state of FIG. 11 in one direction and to be readily rigid (in the flat state) in an opposite direction.

The backing member 202 can assume a variety of shapes and sizes, including any of the length and width dimensions mentioned above. The backing member 202 includes a plurality of panels 210, adjacent ones of which are connected by a hinge segment 212. The plurality of panels 210 includes opposing, outermost panels 210*a*, 210*b* that in turn define opposing side edges 214*a*, 214*b* of the backing device 200. The plurality of panels 210 can further include a central panel 210*c* that optionally is wider than a remainder of the panels 210 (that can otherwise have an identical shape and size). A passage 216 can be formed in the central panel 210*c*. Regardless, the hinge segments 212 are configured to permit articulation of the panels 210 relative to one another, and optionally such that the panels 210 cannot be articulated beyond the flat state (in one direction).

Figure 12A:
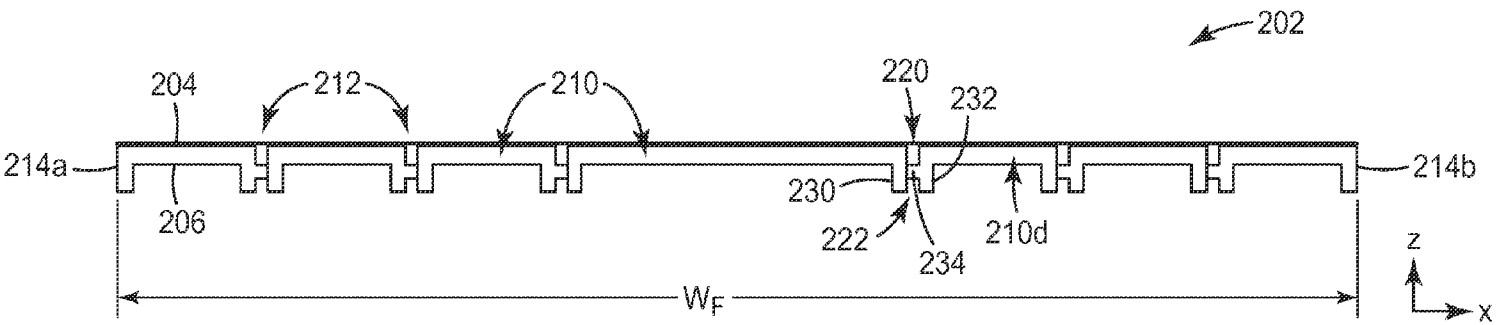
FIG. 12A is a side view of a backing member component of the backing device of FIG. 11 and in a flat state.
Figure 12B:
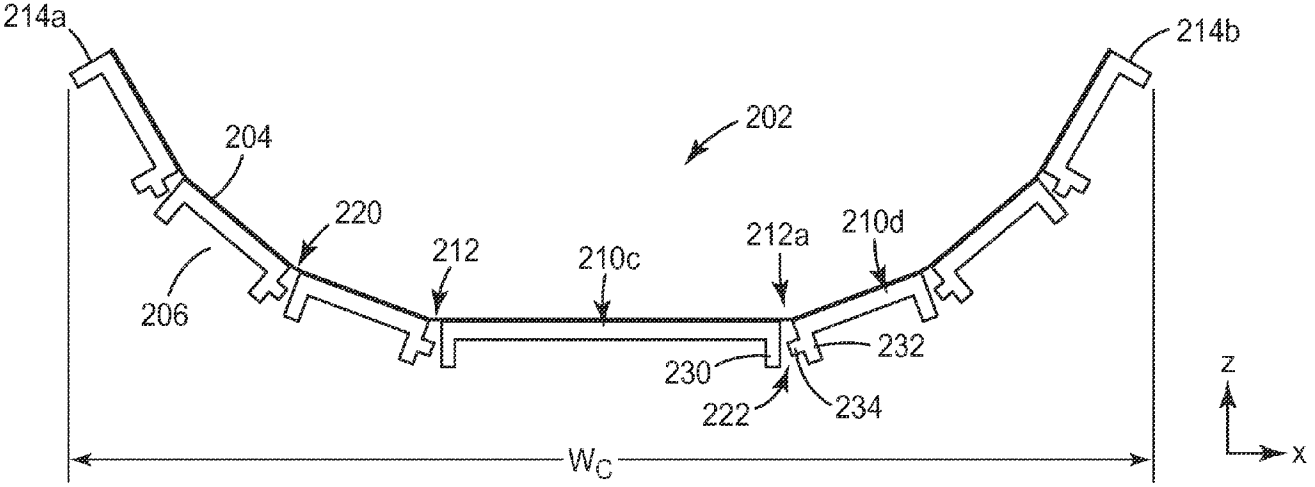
FIG. 12B is a side view of the backing member of FIG. 12A in a collapsed state.

For example, FIG. 12A illustrates the backing member 202 in the flat state, whereas FIG. 12B provides one example of a collapsed state (it being understood that the backing member 202 can be articulated to a number of other collapsed state arrangements). Relative to orientations of FIGS. 12A and 12B, as well as the identified the x (or width) and z (or depth) directions, the hinge segments 212 readily permit the backing member 202 to fold from the flat state in the positive z or depth direction. Comparing FIG. 12A with 12B, then, folding of the backing member 202 from the flat state entails the opposing side edges 214*a*, 214*b* being articulate closer to one another in the positive z (or depth direction), such that the maximum width $W_C$ of the backing member 202 in the collapsed state (FIG. 12B) is less than the maximum width $W_F$ of the backing member 202 in the flat state (FIG. 12A). Stated otherwise, the backing member 202 is configured to readily articulate or fold from the flat state in a direction of the front face 204 (i.e., the collapsed state entails the front face 204 generally forming or defining a concave curve, whereas the rear face 206 generally forms or defines a convex curve). While the hinge segments 212 readily allow for articulation or folding of the backing member 202 from the collapsed state toward the flat state (e.g., the backing member 202 is readily transitionable in the negative z or depth direction from the collapsed state of FIG. 12B to the flat state of FIG. 12A), once in the flat state, the hinge segments 212 resist or prevent further folding in the negative z or depth direction. Thus, the backing member 202 overtly resists folding or collapsing thereof in a manner that might otherwise result in the front face 204 forming or defining a convex curve, or in the rear face 206 forming or defining a concave curve. This optional reinforced configuration of the backing member 202 promotes assembly of the backing device 200 (FIG. 11) to a wall surface as made clear below.

The hinge segments 212 can assume a variety of different configurations appropriate for effectuating the optional performance characteristics described above. For example, in an exemplary embodiment, the hinge segments 212 are each partially defined by a thin, continuous web 220 extending between and interconnecting the panels 210. The web 220 is flexible and permits repeated articulation of adjacent panels 210 while maintaining its structural integrity. Further, each hinge segment 212 includes a stop arrangement 222 (identified for the hinge segment 212*a* between the central panel 210*c* and an immediately adjacent panel 210*d*) configured to overtly resist articulation of the corresponding, adjacent panels (e.g., the panels 210*c*, 210*d*) beyond the flat state (in a direction of the rear face 206). The stop arrangement 222 can be identical for each of the hinge segments 212. With specific reference to the stop arrangement 222 of the hinge segment 212*a* between the central and immediately adjacent panels 210*c*, 210*d*, the stop arrangement 222 includes, in some embodiments, a first rail 230 projecting from the central panel 210*c* in a direction of the rear face 206, a second rail 232 projecting from the immediately adjacent panel 210*d* in a direction of the rear face 206, and a rib 234 projecting from the second rail 232 in a direction of the first rail 230. In the collapsed state of FIG. 12B, the rib 234 is spaced from the first rail 230 such that the stop arrangement 222 does not impede folding of the panels 210*c*, 210*d* relative to one another in either z (or depth) direction. However, the stop arrangement 222 is configured such that in the flat state of FIG. 12A, the rib 234 contacts or abuts the first rail 230, impeding or preventing the panels 210*c*, 210*d* from folding relative to one another in the negative z or depth direction (i.e., in a direction of the rear face 206).

Figure 13:
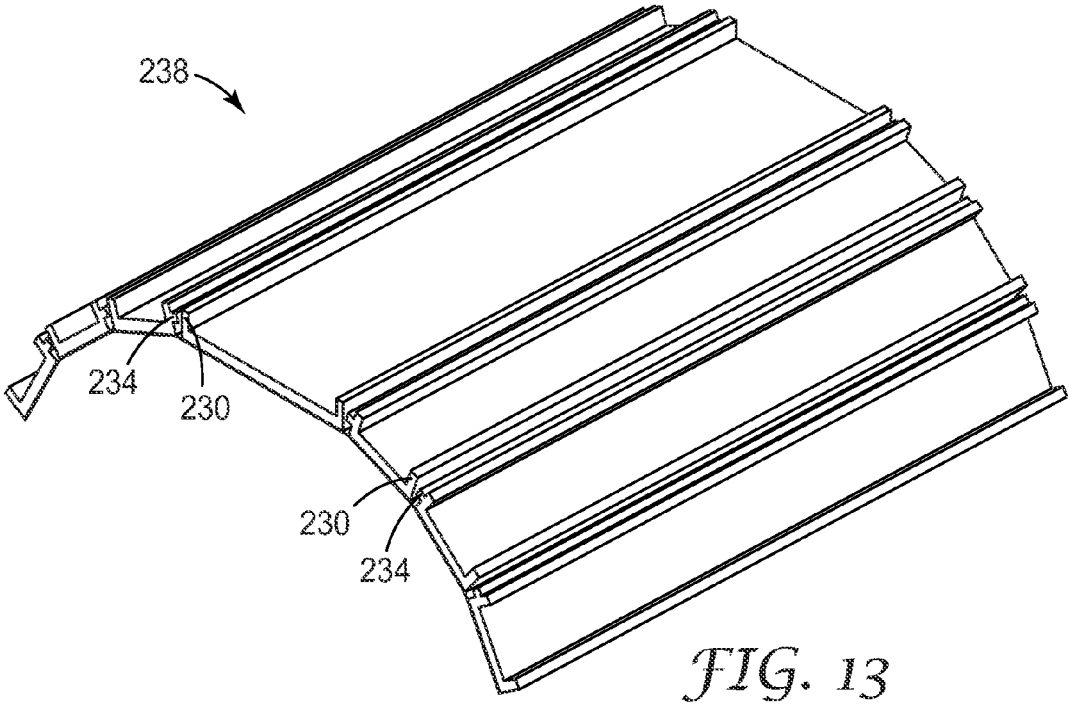
FIG. 13 is a perspective view of the backing member of FIG. 12A as an extruded part.

The stop arrangement 222 can assume a number of other formats appropriate for preventing over-folding of the backing member 202 in a direction of the rear face 206 beyond the flat state. With the exemplary embodiments of FIGS. 11-12B, however, the hinge segments 212 (i.e., the continuous web 220 and stop arrangement 222) are well-suited for forming the backing member 202 as a continuous, extruded plastic part. FIG. 13 illustrates a possible shape or profile of an extruded backing member 238 as it exits the extruder's die; the generally curved profile 238 provides sufficient spacing between the ribs 234 and the opposing first rails 230 for extrusion to be viable. The optional holes described above (e.g., the passage 216 (FIG. 11)) can be die cut into the extruded part 238. Other materials and/or production techniques are also acceptable.

Returning to FIG. 11, the adhesive strips 24*a*, 24*b* can assume any of the forms described above, and are pre-assembled to the front face 204 of the backing member 202, or alternatively can be applied by the end user in some embodiments.

Figure 14:
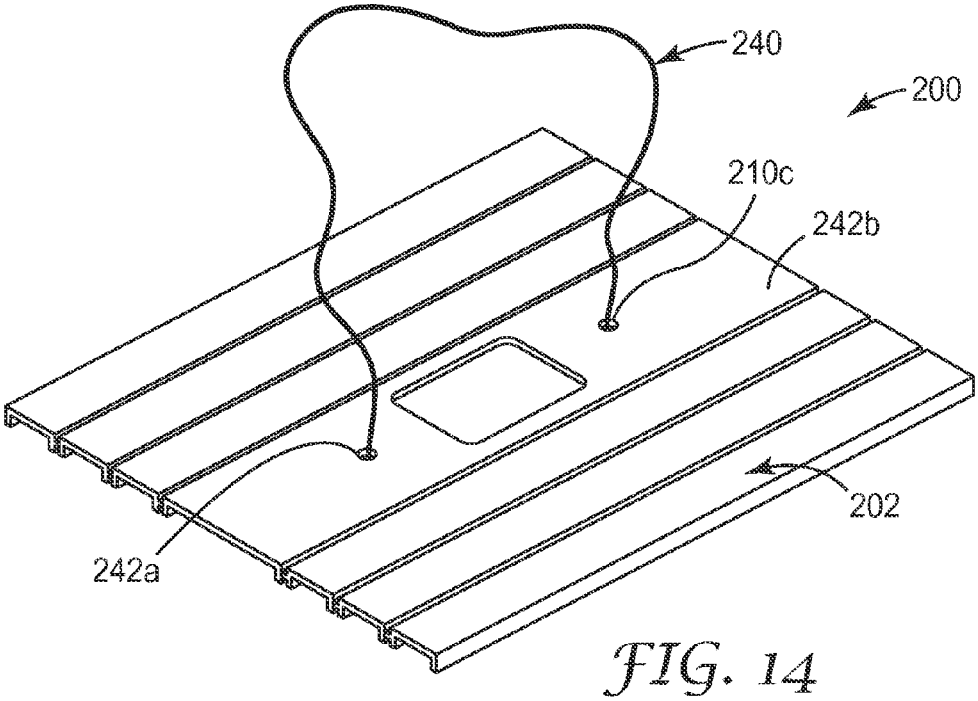
FIG. 14 is a perspective view of another embodiment backing device of the present disclosure and useful with the kit of FIG. 3.

The backing device 200 can optionally include one or more additional components, such as a tether 240 as generally shown in FIG. 14. The tether 240 can assume various forms (e.g., string, plastic strap, wire, etc.) and can be connected to the backing member 202 via optional bores 242*a*, 242*b* formed through the central panel 210*c*. Other mounting techniques are equally acceptable. Where provided, the tether 240 can be secured about a user's wrist keeping the backing member 202 connected to the user in case the user accidentally drops the backing device 200.

The backing device 200 can be provided to a user as part of a kit, for example akin to the kit 70 (FIG. 3) described above. However, only one backing device 200 need be included with the kit.

Figure 15A:
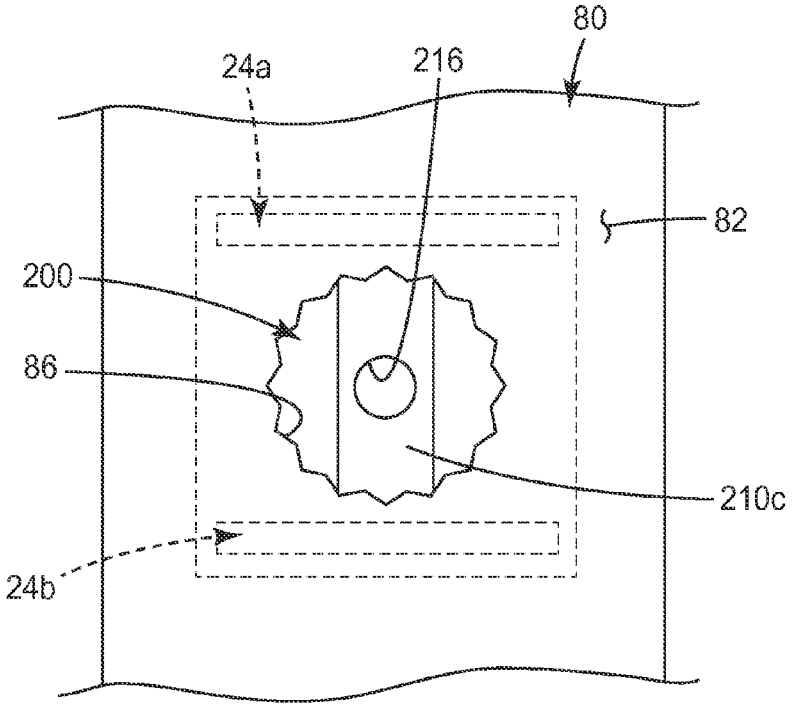
FIGS. 15A-17C illustrate use of the backing device of FIG. 11 in repairing a hole in a wall.
Figure 15B:
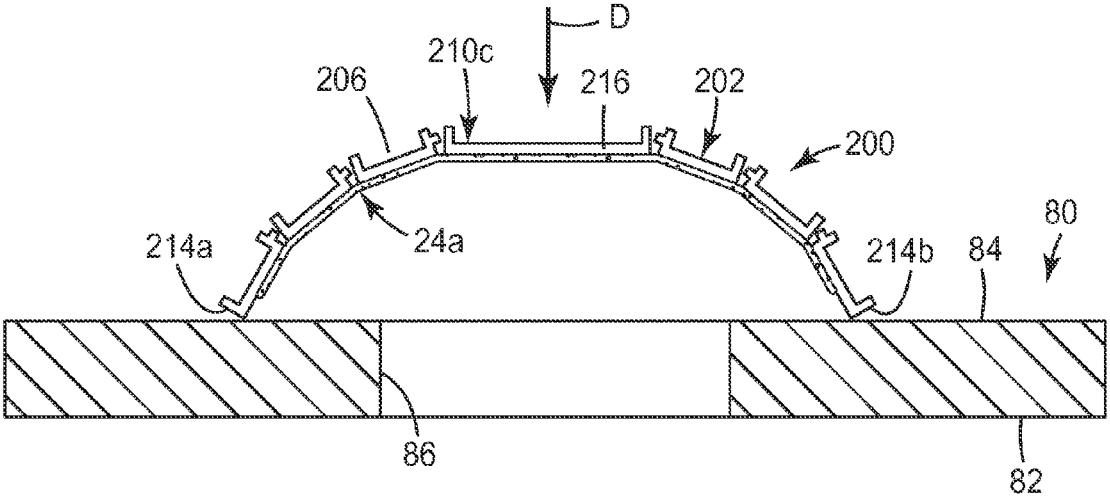

In many respects, use of the backing device 200 in repairing a wall hole (such as the hole 86 (FIGS. 4A and 4B) described above) can be similar to previous explanations. The end user may initially trim the backing device 200 to a desired size based upon an evaluation of a size of the hole 86. Regardless, the backing device 200 is folded to arrange the backing member 202 in a collapsed state appropriately-sized to fit through the hole 86. FIGS. 15A and 15B illustrate the backing device 200 as initially deployed "behind" the wall 80, arranged such that the adhesive strips 24*a*, 24*b* are facing the back surface 84. As perhaps best reflected by FIG. 15A, the passage 216 in the central panel 210*c* provides a convenient region for a user to handle the backing device 200, including applying a force or pressure on to the rear face 206 of the backing member 202 (e.g., one or more of the user's fingers are inserted through the passage 216 in grasping the backing device 200 and applying pressure on to the rear face 206). Where provided, the tether 240 (FIG. 14) can be wrapped about the user's wrist; in the event the user inadvertently drops the backing device 200 while manipulating it behind the wall 80, the tether 240 will prevent the backing device 200 from dropping to the ground behind the wall 80.

FIG. 15B best reflects that the backing device 200 can assume a somewhat curved shape as first deployed behind the wall 80 by the user, with the opposing side edge 214*a*, 214*b* contacting (or nearly contacting) the back surface 84 and a remainder of the backing device 200 naturally curving away from the back surface 84. To bring the adhesive strips 24*a*, 24*b* (one of which is visible in FIG. 15B) into complete contact with the back surface 84, the user applies a force onto the rear face 206 of the backing member 202, pulling the backing device 200 toward the back surface 84 (indicated by the arrow D in FIG. 15B). Once again, the user's finger(s) otherwise applying the force are inserted through the passage 216 and thus generally centrally located relative to a shape of the backing member 202. Thus, the so-applied pulling force is centrally applied on to the backing member 202.

Figure 16:
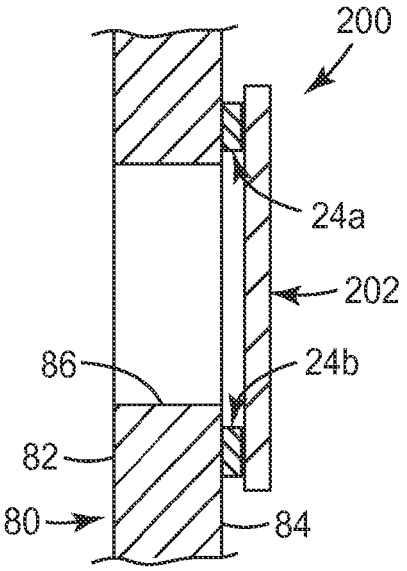

In response to the user-applied pulling force, the opposing side edges 214*a*, 214*b* bear against the back surface 84, and the backing member 202 is forced toward the flat state. As shown in FIG. 16, the backing member 202 is ultimately forced to flat state, with the adhesive surface 60 of the adhesive strips 24*a*, 24*b* brought into more complete, intimate contact with the back surface 84, thus attaching the backing device 200 to the wall 80.

Figure 17A:
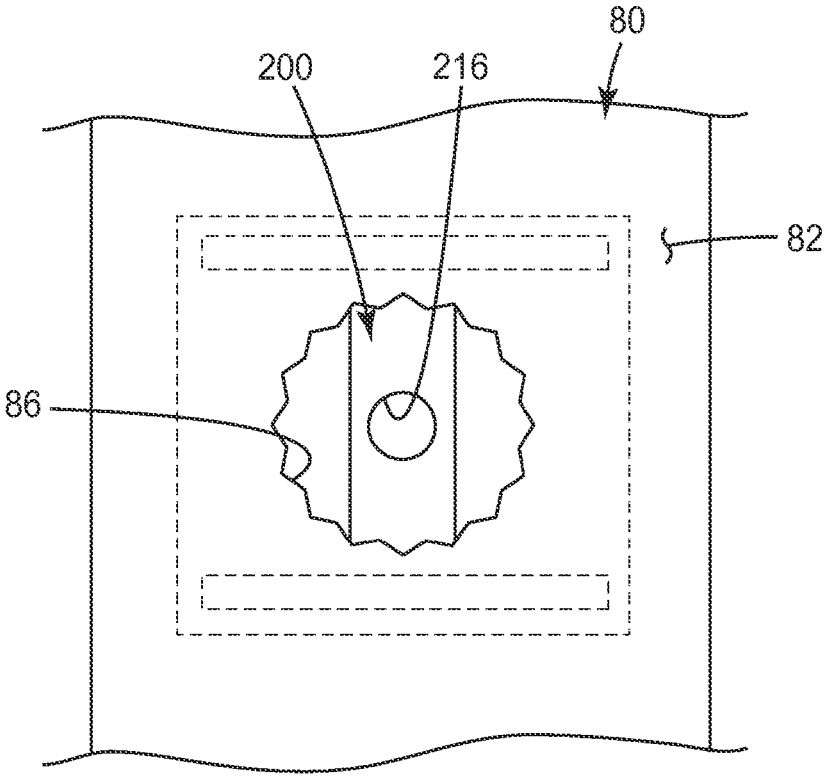
Figure 17B:
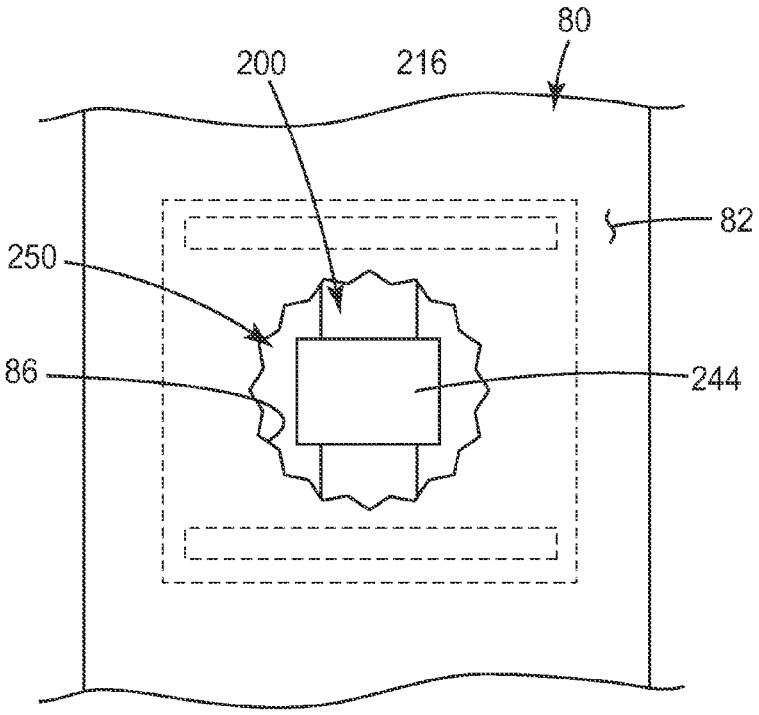
Figure 17C:
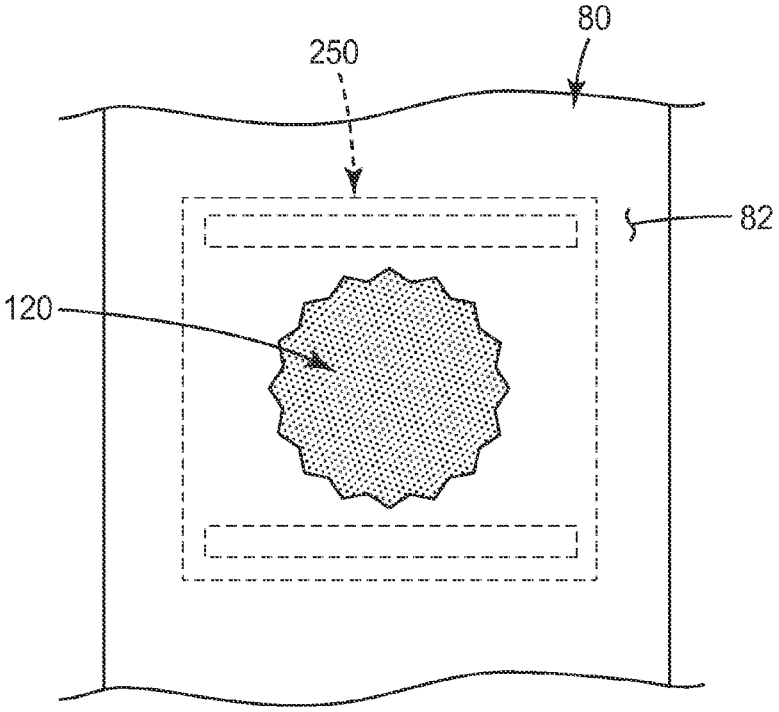

FIG. 17A is a front view of the backing device 200 as attached to the wall 80. The backing device 200 encompasses or covers the hole 86 except at the passage 216. Where provided, the tether 240 (FIG. 14) can be disconnected from the backing member 202 (e.g., cut and removed), or can simply be inserted back through the passage 216 (and thus "behind" the wall 80). Regardless, the passage 216 is then covered by a cover article 244 as shown in FIG. 17B. The cover article 244 can assume any of the forms described above (e.g., one or more strips of tape, a metal mesh, etc.), and combines with the backing device 200 to define a scaffold structure 250. The wall repair compound 120 can then be applied to the scaffold structure 250 as shown in FIG. 17C in accordance with any of the descriptions above.

Figure 18:
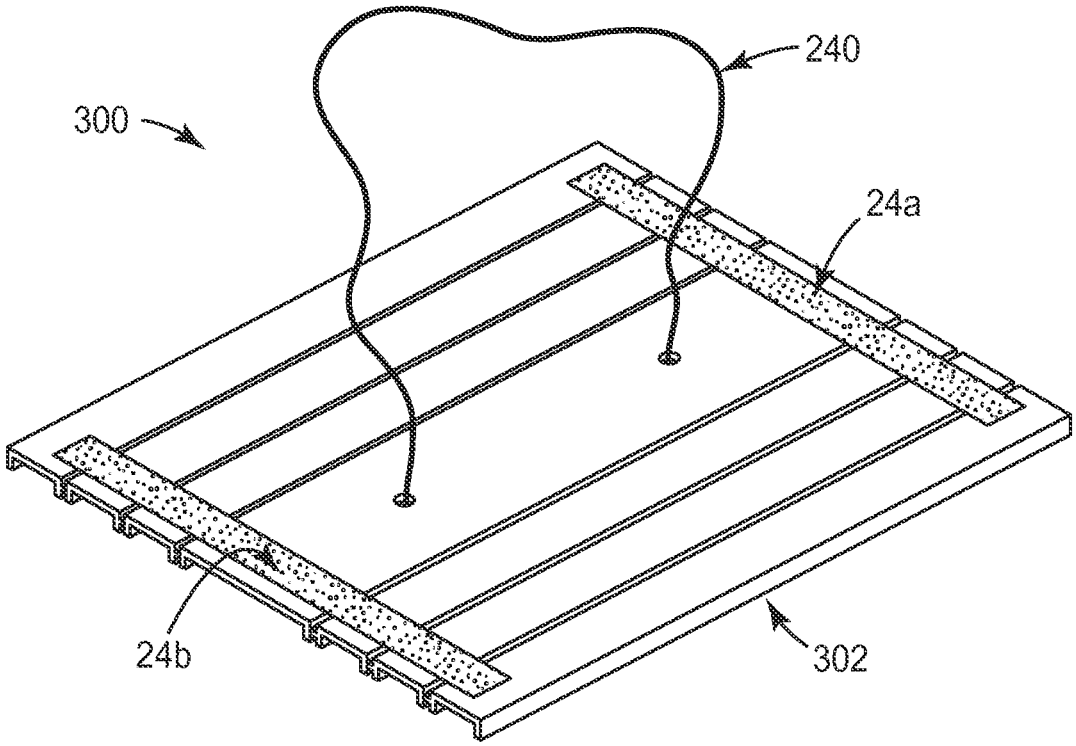
FIG. 18 is a perspective view of another embodiment wall repair backing device in accordance with principles of the present disclosure and useful with the kit of FIG. 3.

Another, related embodiment backing device 300 is shown in FIG. 18, and includes a backing member 302, the adhesive strips 24*a*, 24*b*, and the tether 240. The backing member 302 can assume any of the forms described above. The backing member 302 can be identical to the backing member 202 (FIG. 11), except that with the exemplary embodiment of FIG. 18, the backing member 302 need not include the passage 216 (FIG. 11). The adhesive strips 24*a*, 24*b* and the tether 240 can have any of the constructions or formats described above. The backing device 300 can be provided as part of a kit, and can be deployed into a wall hole generally in accordance with previous descriptions. Following initial deployment of the backing device 300 "behind" the to-be-repaired wall, the backing member 302 is transitioned to a flat state, and the adhesive surface 60 of the adhesive strips 24*a*, 24*b* brought into contact with the back surface of the wall by a user applying a pulling force on to the tether 240. Once the backing device 300 is secured to the wall surface, the tether 240 can be removed from the backing member 302 (e.g., cut) and/or can be lodged within the hole and the spackling compound applied over the tether 240. The cover articles described above are not necessary with the backing device 300.

Figure 19B:
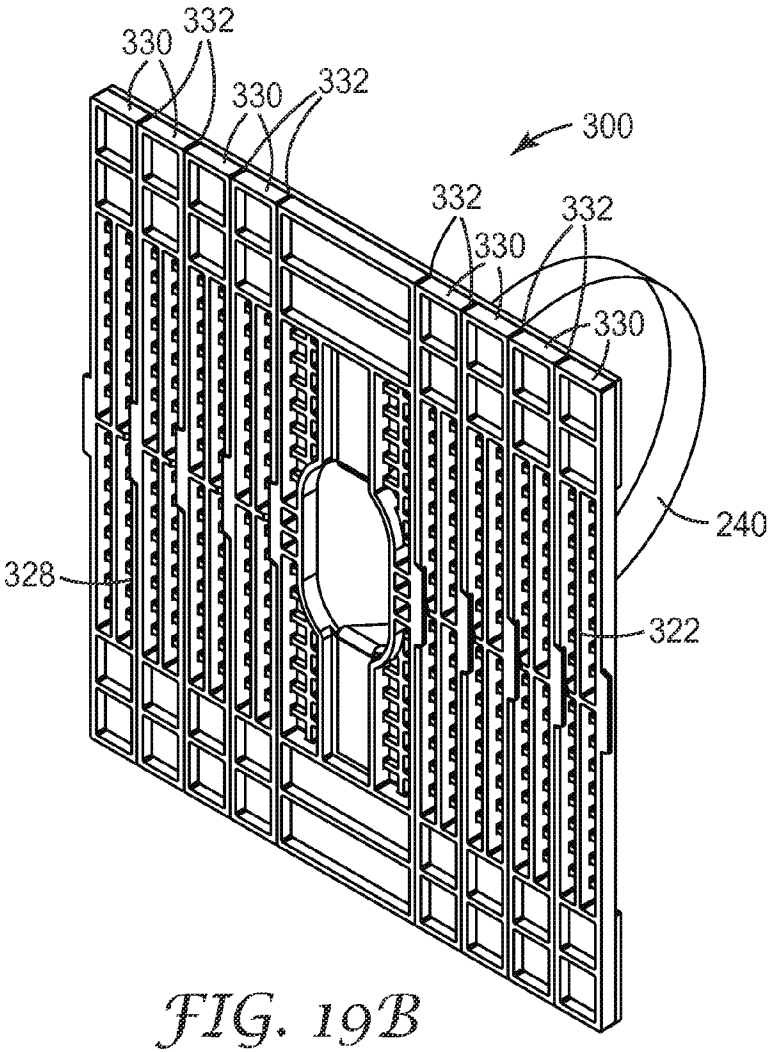
FIGS. 19A and 19B are schematic perspective views of another embodiment of a backing device of the type generally described herein
Figure 19A:
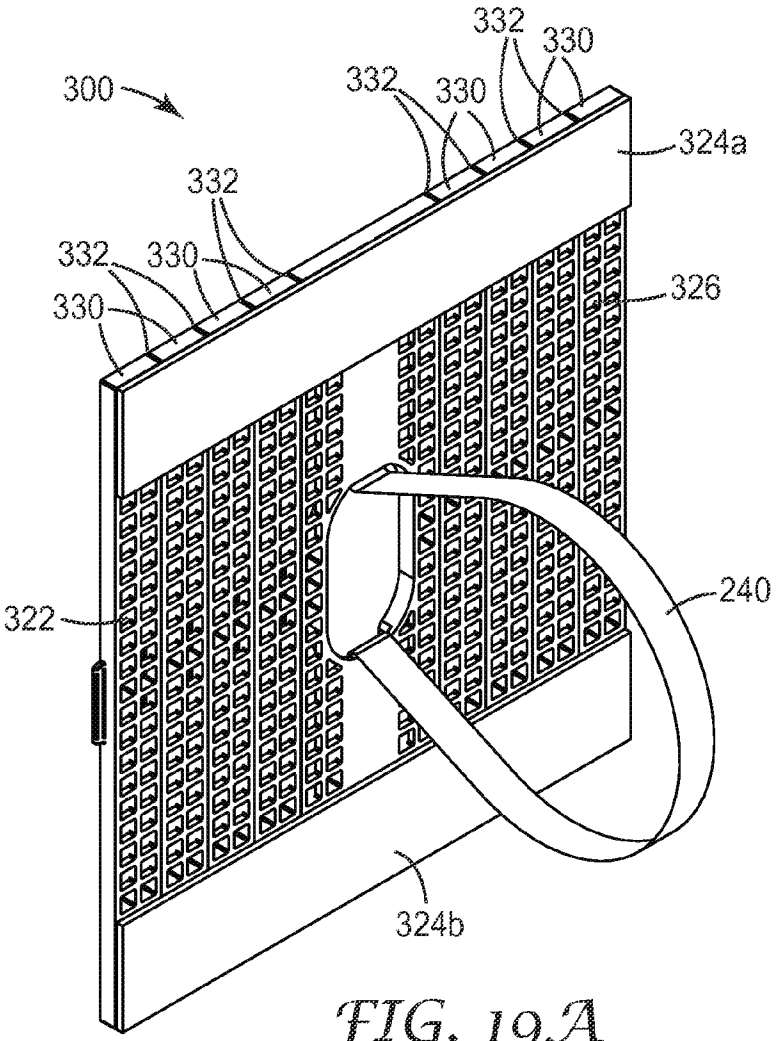

Another backing device 300 in accordance with principles of the present disclosure, and useful with optional kits and methods of the present disclosure, is shown in FIGS. 19A and 19B. The backing device 300 includes a foldable backing member 322 and at least two adhesive strips 324*a*, 324*b*. Details on the various components are provided herein. In general terms, backing member 322 is foldable or collapsible from the flat state of FIGS. 19A and 19B (having a size or footprint that is larger, in at least one dimension, than the hole to be repaired) to a collapsed or folded state that more readily fits through the hole to be repaired. Once manipulated through the hole, backing member 322 is permitted or caused to revert to the flat state (including, in some embodiments, the backing member 322 optionally self-reverting back toward the flat state). Then, with the backing member 322 in the flat state, the backing device 300 is attached to a back surface of the wall via the adhesive strips 324*a*, 324*b*. In some embodiments, the backing member 322 is readily collapsible from the flat state in one direction and is relatively rigid (in the flat state) in the opposite direction.

Backing member 322 generally defines a front face 326 (FIG. 19A) opposite a rear face 328 (FIG. 19B). As is discussed herein, backing member 322 can assume a wide variety of forms capable of being folded from the flat state to a collapsed state, and exhibiting sufficient rigidity in at least one direction (while in the flat state). Backing member 322 includes a plurality of panels 330, adjacent ones of which are connected by a corresponding hinge segment 332. For example, the exemplary backing member 322 of FIGS. 19A and 19B include nine panels and eight hinge segments 332. As described herein, the embodiment of FIGS. 19A and 19B is merely exemplary and any features of this embodiment can be altered, including altered using teachings herein or known to those of ordinary skill in the art to create equivalents.

The wall repair devices, kits and methods of the present disclosure provide a marked improvement over previous designs. The backing device of the present disclosure is inexpensive, and is easily handled and manipulated by a user in establishing a scaffolding structure behind a wall hole for receiving a spackling or other wall repair compound.

The patents, patent documents, and patent applications cited herein are incorporated by reference in their entirety as if each were individually incorporated by reference. It will be apparent to those of ordinary skill in the art that various changes and modifications may be made without deviating from the inventing concepts set from above. Thus, the scope of the present disclosure should not be limited to the structures described herein.

What is claimed is:

1. A backing device for use in repairing a hole in a wall, the backing device comprising:

a collapsible backing member defining a front face and a rear face, the backing member including a central panel, a first outer panel and a second outer panel, wherein the central panel is connected to the first outer panel at a first hinge segment and the second outer panel is connected to the first outer panel at a second hinge segment, and wherein the central panel is wider than either the first or second outer panel; and first and second adhesive strips disposed on the front face;

wherein the backing member is configured to provide a flat state and is configured to be foldable from the flat state to a collapsed state in a direction of the front face;

wherein the backing member is further configured to be relatively rigid in the flat state in a direction of the rear face; and wherein each hinge segment includes a stop arrangement on the rear face for inhibiting folding of the hinge segment in the flat state in the direction of the rear face.

2. The backing device of claim 1, wherein the backing member is an integrally formed, extruded plastic part.

3. The backing device of claim 1, wherein the backing member defines a passage through a thickness of the central panel configured to receive a user's finger.

4. The backing device of claim 1, wherein the panels are pop sticks and the hinge segment is formed by a film interconnecting the pop sticks.

5. A kit for repairing a wall hole, the kit comprising:

a backing device of claim 1 and a wall repair compound.

6. The kit of claim 5, further comprising a cover article configured to be selectively applied to the backing device.

7. The kit of claim 6, wherein the backing device and the cover article combine to define a support structure for receiving the wall repair compound.

8. The backing device of claim 1, wherein the collapsed state entails the front face forming a concave curve.

9. The backing device of claim 1 and further comprising a flexible layer extending across at least a portion of the rear face of each of the central and outer panels to thereby interconnect the panels.

10. The backing device of claim 1, wherein each panel includes a plurality of apertures extending through a thickness of the panel.

11. The backing device of claim 1, and further comprising a third outer panel connected to the central panel at a third hinge segment.

12. The backing device of claim 11, and further comprising a fourth outer panel connected to the third panel at a fourth hinge segment.

13. The backing device of claim 1, wherein first hinge segment defines a first hinge axis, the second hinge segment defines a second hinge axis, and wherein the first hinge axis extends parallel to the second hinge axis.

14. The backing device of claim 1, wherein the first and second outer panels are separable from one another at the second hinge segment.

15. A backing device for use in repairing a hole in a wall, the backing device comprising:

a collapsible backing member defining a front face and a rear face, the backing member including first and second outer panels and a central panel wider than either the first or second outer panel, wherein the first and second outer panels are connected at a first hinge segment and the first outer panel and central panel connected at a second hinge segment, with each hinge segment including a flexible material extending across at least a portion of the rear face of the panels to interconnect the panels; and first and second adhesive strips disposed on the front face;

wherein the backing member is configured to provide a flat state and is configured to be foldable from the flat state to a collapsed state in a direction of the front face;

wherein the backing member is further configured to be relatively rigid in the flat state in a direction of the rear face; and wherein the hinge segment includes a stop arrangement on the rear face for inhibiting folding of the hinge segment in the flat state in the direction of the rear face.

16. The backing device of claim 15, wherein each panel includes a plurality of passages from the front face to the rear face.

17. The backing device of claim 15, wherein the backing member defines a passage through a thickness of the central panel configured to receive a user's finger.

18. The backing device of claim 15, wherein first hinge segment defines a first hinge axis, the second hinge segment defines a second hinge axis, and wherein the first hinge axis extends parallel to the second hinge axis.

19. The backing device of claim 15, wherein the collapsed state entails the front face forming a concave curve.

* * * * *